United States Patent [19]

Marrs

[11] Patent Number: 4,823,668

[45] Date of Patent: Apr. 25, 1989

[54] RESONATOR GUITAR SIMULATOR

[76] Inventor: M. Duane Marrs, 1258 Sioux Ter., Madison, Tenn. 37115

[21] Appl. No.: 149,474

[22] Filed: Jan. 28, 1988

[51] Int. Cl.[4] ..... G10D 3/02

[52] U.S. Cl. ..... 84/296; 84/173; 84/267

[58] Field of Search ..... 84/173, 267, 291-296

[56] References Cited

U.S. PATENT DOCUMENTS

| | | | |
|---|---|---|---|
| 1,707,115 | 3/1929 | Dierdorf | 84/294 X |
| 1,808,756 | 6/1931 | Beauchamp | 84/296 |
| 2,029,469 | 2/1936 | Dopyera | 84/296 |
| 2,897,709 | 8/1959 | McCarty et al. | 84/1.15 |
| 4,704,935 | 11/1987 | Franklin | 84/312 P |

*Primary Examiner*—Lawrence R. Franklin
*Attorney, Agent, or Firm*—Harrington A. Lackey

[57] ABSTRACT

A stringed musical instrument having a sound box including a resonator having a solid top wall and a resonator chamber opening through the bottom surface of the sound box, and a bridge bar in contact with both the top wall of the resonator and the strings of the instrument.

9 Claims, 1 Drawing Sheet

RESONATOR GUITAR SIMULATOR

BACKGROUND OF THE INVENTION

This invention relates to a stringed musical instrument, and more particularly to a resonator guitar-type musical instrument having a unique sound.

In a typical guitar, a sound hole is formed through the top of the sound board of the sound box, but the remainder of the sound chamber within the sound box is completely enclosed. The bridge is mounted toward the tail end of the sound box to support the tail ends of the strings which extend across the sound hole and longitudinally over the neck or fret board to the peg box of the guitar.

In an electric guitar, an electrical pick-up is mounted on the sound board or neck beneath the strings to pick up the sound created by the strings and convert the sound waves into electrical signals, which are amplified.

In a "Do-Bro", which is an acoustical guitar with a resonator in the sound box of the guitar, the open-dish type resonator is protected by a perforated top or face cover.

U.S. Pat. No. 4,704,935, issued to Paulie H. Franklin on Nov. 10, 1987, discloses a stringed musical instrument incorporating a resonator chamber within the sound box and a transverse bridge bar in solid contact with a spider frame in the open top of the resonator chamber. The bridge bar is in contact with the strings of the instrument.

SUMMARY OF THE INVENTION

This invention relates to a stringed musical instrument in the nature of an acoustical guitar having an electrical pick-up and a novel resonator chamber which produces a different resonating sound.

The resonator guitar made in accordance with this invention is an improvement over a "Do-Bro" or conventional resonator guitar in that it is of smaller size, utilizing a smaller resonator of different construction, together with an electrical pick-up for amplifying the sound.

The stringed musical instrument made in accordance with this invention includes an elongated, solid base upon which is mounted a peg box, a sound box, and an elongated hollow neck extending between the peg box and the sound box. Contained within the sound box is a resonator having a cylindrical side wall, a solid top wall, and a bottom opening through the bottom surface of the instrument. An elongated solid metal bridge bar is mounted transversely within the sound board of the sound box and in mechanical contact with the top wall of the resonator. An electrical pick-up is also mounted in the sound board between the bridge bar and the neck. A plurality of strings extend from the peg box longitudinally over the hollow neck and the pick-up to the tail piece. The strings engage the bridge bar in mechanical contact to facilitate the transfer of sound waves from the strings through the bridge bar and the top wall of the resonator into the resonator chamber. The resonating sound waves are then transmitted back through the top wall, the bridge bar and the strings to the electrical pick-up for conversion to electrical signals, which are amplified.

DESCRIPTION OF THE PREFERRED EMBODIMENT

Figure 1:
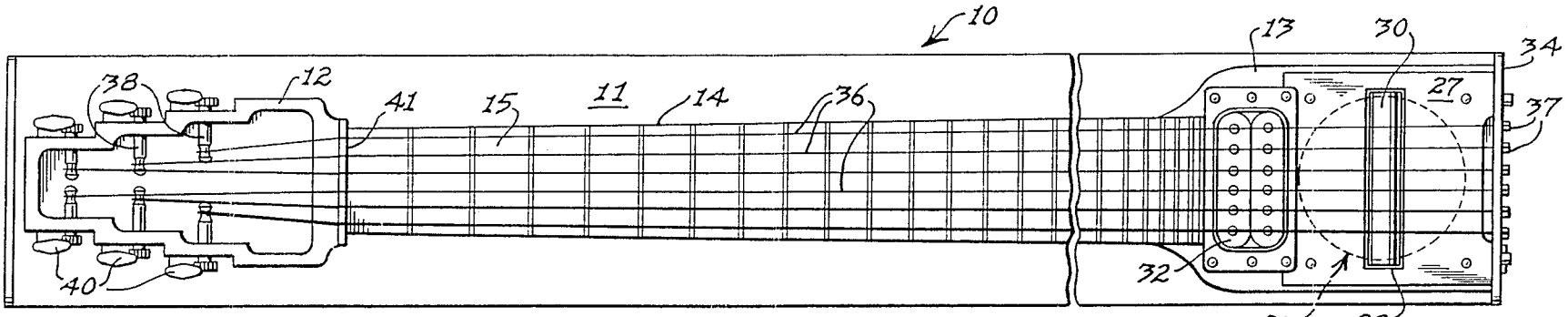
FIG. 1 is a top plan view of the stringed musical instrument made in accordance with this invention, with portions broken away.
Figure 2:
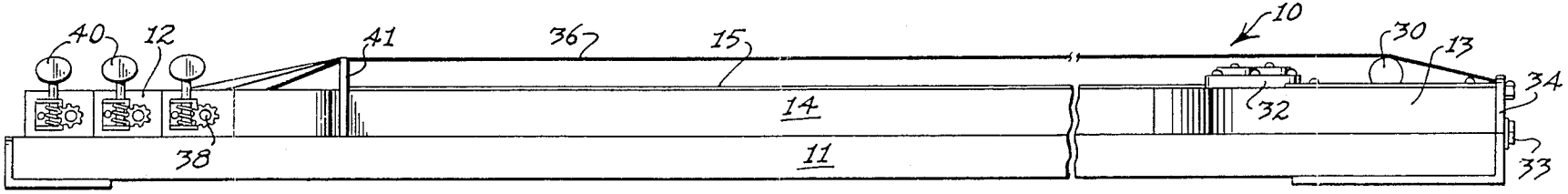
FIG. 2 is a side elevational view of the instrument disclosed in FIG. 1, with portions broken away.

Referring now to the drawings in more detail, FIGS. 1 and 2 disclose a stringed musical instrument 10 made in accordance with this invention. The instrument 10 includes an elongated, solid base or base member 11 preferably rectangular. A peg box 12 is mounted at the head-end portion of the base 11; a sound box 13 is mounted at the tail-end portion of the base 11; and an elongated, hollow neck 14 is mounted on the base 11, extending between the peg box 12 and the sound box 13. The top surface or face of the neck 14 comprises an elongated fret board 15.

Figure 5:
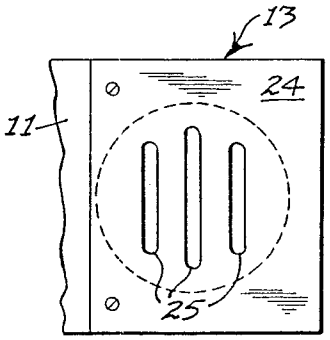
FIG. 5 is a reduced fragmentary bottom plan view of the tail-end portion of the instrument, taken along the line 5—5 of FIG. 4.
Figure 4:
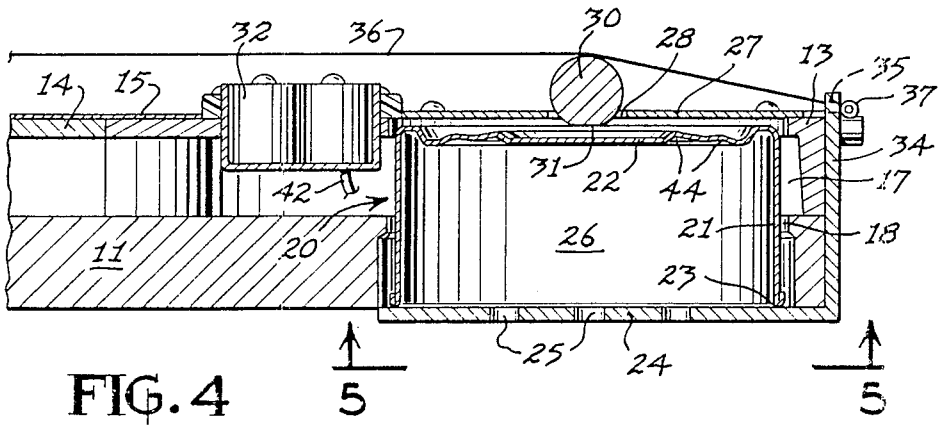
FIG. 4 is an enlarged fragmentary section taken along the line 4—4 of FIG. 3 of the tail-end portion of the instrument, including the sound box and a portion of the neck.

The sound box 13 includes a hollow sound chamber 17 which is an extension of the hollow space within the neck 13, and includes a hollow extension chamber 18 formed within the tail portion of the base 11. Fitted within the chambers 17 and 18 is a resonator 20 including a cylindrical side wall 21, and a solid top wall 22 which is made in the form of a vibratory membrane or diaphragm. The bottom of the resonator 20 includes a bottom opening 23 through the bottom surface of the base 11, and is covered by a cover plate 24 having a plurality of open slots, such as the longitudinally spaced, transverse slots 25 disclosed in FIGS. 4 and 5. Thus, the walls 21 and 22 and the slotted cover plate 24 define an open-bottom resonator chamber 26 (FIG. 4).

Covering the top of the sound box 13 is a sound board or plate 27 having an elongated transverse slot 28 therein for receiving an elongated transverse solid bridge bar 30. The bridge bar 30 is cylindrical in cross-section with the exception of a bottom elongated flat surface 31 which lies flush in mechanical or physical contact, or continguous with, portions of the top surface of the top wall 22.

Figure 3:
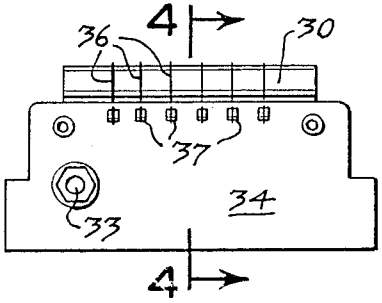
FIG. 3 is a tail-end elevational view of the instrument disclosed in FIG. 1.

Recessed within the top of the sound box 13 is an elongated, transversely extending electrical pick-up 32 of any conventional manufacture. The pick-up 32 is connected electrically through an electrical conductor, such as 42 (FIG. 4), to the jack socket 33 (FIGS. 2 and 3), for connection to an amplifier, not shown.

A tail-piece 34 is mounted on the tail-end portion of the sound box 32, and, as disclosed in the drawings, is preferably formed integrally with the cover plate 24 in an L-shaped configuration. The tail-piece 34 projects slightly above the sound box 13 and is provided with apertures 35 for receiving the musical strings 36. The tail-end portions of the musical strings 36 are secured within the apertures 35 by conventional connectors 37.

The head ends of the strings 36 are connected to their respective pegs 38 in the peg box 12 and are adjustable by the screws 40, as shown, in a conventional manner.

The strings 36 extend from their connectors 37 in the tail-piece 34 longitudinally and angularly across and in binding contact with the transverse bridge bar 30. The strings 36 then extend longitudinally of and spaced above the pick-up 32 and the fret board 15, and across the guide piece 41 to their respective pegs 38. The head end portions of the strings 36 are wound about their respective pegs 38, in a conventional manner.

The bridge bar 30 is held inp hysical or mechanical contact with the top surface of the top wall 22 of the resonator 20 by the tension in the bent musical srings 36 binding against the bridge bar 30.

In the playing of the instrument 10, a conventional electrical cord, not shown, is connected by its jack into the jack socket 33 to energize the electrical pick-up 32. As the instrument is playd by plucking the strings 36, the vibration of the strings 36 are transmitted through the solid medium of the bridge bar 30 to the solid, but slightly flexible, top wall 22 of the resonator 20. The sound waves are then transmitted into the resonator chamber 26 where they reverberate and are re-transmitted back through the top wall 22, bridge bar 30 and the strings 36. The sound waves from the vibrating strings 36 are then transmitted through the air to the transducer or pick-up 32, which converts the sound waves to electrical vibrations. The electrical signals are in turn amplified through the amplifier, not shown, and reconverted to audio waves through a loud speaker, not shown.

It has been found that the instrument 10 made in accordance with this invention, including the resonator 20 having the closed, vibratory solid top wall 22 and an open bottom 23 produces a novel sound appealing to varied audiences.

In a preferred form of the invention, the transverse bridge bar 30 is made of solid metal, such as steel, while the entire resonator 20, that is the side wall 21 and top wall 22, is also made of metal, such as aluminum, steel, or metal alloys. However, a different sound may be obtained by utilizing a solid wood bridge bar 30.

The top wall or diaphragm 22 may be formed in different configurations, so long as it vibrates in response to the sound waves transmitted from the strings 36 and bridge bar 30, as well as from the resonant sound waves within the resonator chamber 26. The top wall 22 preferably is a solid, substantially flat member or membrane having annular ribs 44 to produce a softer, more desirble sound simulatingthe sound of a resonator guitar.

The slots 25 permit the emission of some sound waves from the resonator chamber 26. Thus, when a musician is practicing playing the instrument 10 in a quiet room, the sounds of the instrument may be heard without the energization of the pick-up 32 and without an amplifier.

What is claimed is:

1. A stringed musical instrument comprising:

(a) a peg box, (b) a sound box having top and bottom surfaces and a tail end portion, and a sound board comprising said top surface, (c) an elongated hollow neck extending between said peg box and said sound box, (d) a resonator within said sound box having a cylindrical side wall and a top wall spaced proximate to said sound board, said resonator having an opening through said bottom surface, (e) an elongated solid bridge bar mounted transversely in said sound board and in contact with said top wall, (f) an electrical pick-up mounted in said sound board spaced longitudinally from said bridge bar, and (g) elongated strings extending from said peg box over said neck to said tail end portion, said strings lying in contact with said bridge bar and spanning said pick-up.

2. The invention according to claim 1 in which said bridge bar is made of solid metal.

3. The invention according to claim 2 in which said top and side walls of said resonator are metal.

4. The invention according to claim 3 in which said top wall comprises a solid flexible diaphragm.

5. The invention according to claim 4 in which said top wall comprises a solid, substantially flat member having spaced annular ribs.

6. The invention according to claim 1 in which said bridge bar has an elongated flat surface in physical contact with said top wall.

7. The invention according to claim 1 further comprising a cover plate having open slots therein covering said opening into said resonator chamber.

8. The invention according to claim 7 further comprising a tail piece integral with said cover plate and extending over said tail end portion, and means securing said strings to said tail piece.

9. The invention according to claim 1 further comprising an elongated solid base, said peg box, said sound box, and said elongated hollow neck being mounted upon said base.

* * * * *